US012005313B2

(12) United States Patent
Caputi

(10) Patent No.: US 12,005,313 B2
(45) Date of Patent: Jun. 11, 2024

(54) ADJUSTABLE HANGING BAR

(71) Applicant: Giancarlo Caputi, Naples (IT)

(72) Inventor: Giancarlo Caputi, Naples (IT)

( * ) Notice: Subject to any disclaimer, the term of this patent is extended or adjusted under 35 U.S.C. 154(b) by 16 days.

(21) Appl. No.: 17/618,462

(22) PCT Filed: Sep. 9, 2020

(86) PCT No.: PCT/IT2020/050216

§ 371 (c)(1),
(2) Date: Dec. 11, 2021

(87) PCT Pub. No.: WO2021/048884

PCT Pub. Date: Mar. 18, 2021

(65) Prior Publication Data

US 2022/0355162 A1 Nov. 10, 2022

(30) Foreign Application Priority Data

Sep. 11, 2019 (IT) ..... 102019000016067
Nov. 11, 2019 (IT) ..... 102019000020679

(51) Int. Cl.
*A63B 23/12* (2006.01)
*A63B 21/16* (2006.01)

(52) U.S. Cl.
CPC ..... *A63B 23/1218* (2013.01); *A63B 21/169* (2015.10); *A63B 2225/093* (2013.01)

(58) Field of Classification Search
CPC ..... A63B 21/1627; A63B 21/1636; A63B 21/1654; A63B 21/1681; A63B 21/169; A63B 2225/093; A63B 23/1218
See application file for complete search history.

(56) References Cited

U.S. PATENT DOCUMENTS 4,077,403 A 3/1978 Steele
5,328,428 A * 7/1994 Huang ..... A63B 21/0628 482/99
2013/0310232 A1* 11/2013 Flores ..... A63B 23/0216 482/131

(Continued)

FOREIGN PATENT DOCUMENTS

CN 109289150 A * 2/2019
CN 109289150 A 2/2019

(Continued)

*Primary Examiner* — Zachary T Moore

(74) *Attorney, Agent, or Firm* — Preston Smirman; SMIRMAN IP LAW, PLLC

(57) ABSTRACT

Exerciser (3) for hanging that can be positioned around a door (16), usable by tall and short persons, having an adjustable bar for hanging (1) which can be easily removed to free the passage through the door. It is meant either for hanging exercises, than for vertebral column stretching. It comprises a bar for hanging (1) supported by two uprights (2,2') resting on the floor (8) and fixed to a wall (14) with spacers (12). The existence of said two uprights (2,2') permits: 1) to place the bar (1) also above a door lintel (6), for tall users 2) to removably place the bar (1) internally to the door (16) passage, for short users, thanks to rotating adjusting junctions (18,18'). Therefore this structure does not prevent the use of a door, and permits the user to make brief exercises at any time he passes through the door.

8 Claims, 2 Drawing Sheets

(56) References Cited

U.S. PATENT DOCUMENTS

| | | | | |
|---|---|---|---|---|
| 2016/0023035 | A1* | 1/2016 | Meyer | A63B 1/00 482/38 |
| 2017/0209733 | A1* | 7/2017 | Beaver | A63B 23/0216 |
| 2019/0126088 | A1* | 5/2019 | Henniger | A63B 23/1218 |
| 2019/0269963 | A1* | 9/2019 | Steenekamp | A63B 23/1254 |
| 2020/0384337 | A1* | 12/2020 | Brasch | A63B 23/1218 |

FOREIGN PATENT DOCUMENTS

| | | | |
|---|---|---|---|
| DE | 8707721 | U1 | 10/1987 |
| FR | 2581553 | A2 | 11/1986 |

* cited by examiner

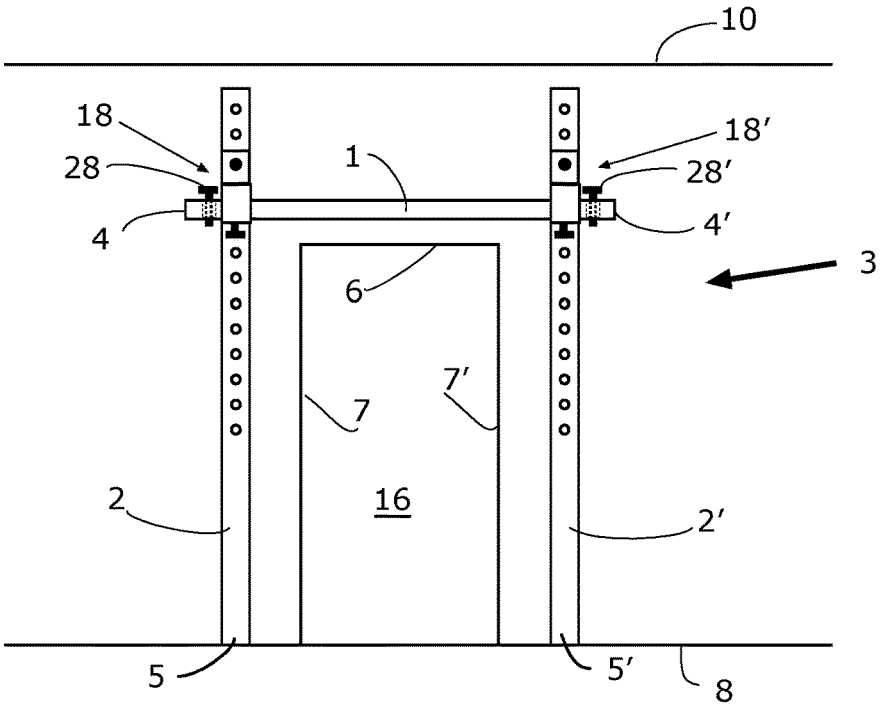
Fig. 1
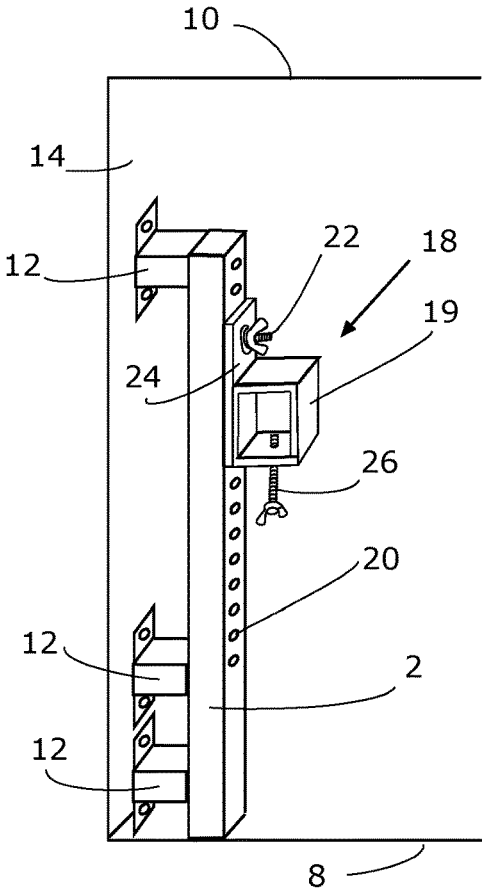
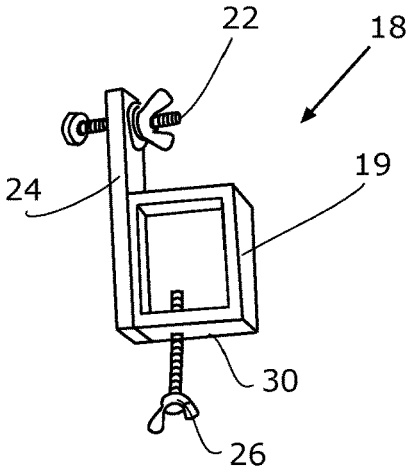
Fig.3
Fig. 2

ADJUSTABLE HANGING BAR

BACKGROUND ART

It is known from US2017209733A1 to provide a training equipment mounted to a side surface of a vehicle or to a wall of a building or a ship. It is known from US2013310232A1 to provide an exercise frame made up of two upright members connected by a transverse base member and a transverse link attached to the top portion of the frame. In commerce there are several types of hanging bars to be attached internally to a door passage, which prevents the passage through said door.

Other types of hanging bars are meant to be fixed to two parallel walls of an aisle. Others are fixed to the ceiling by cables. In such cases it is not easy to adjust the bar and the resistance is often insufficient to stand overweight people.

DISCLOSURE OF INVENTION

The invention relates to an exerciser (3) for hanging one's own body exercises that can be positioned around a door (16), such as a portal, usable either by tall and short persons, having an adjustable bar for hanging (1) which can be easily fixed horizontally, it can be easily removed or rotated vertically to free passage through the door. It is meant either for hanging exercises, than for vertebral column stretching.

The floor is the strongest element that can bear a weight in a house and therefore the bar for hanging (1) of my invention is supported by two uprights (2,2') resting on the floor (8) and fixed to a wall (14) with spacers (12), said bar (1) is connected to said uprights (2.2') with adjustable rotating junctions (18,18') that can be positioned by the user. The presence of said two uprights (2,2') permits: 1) to place the bar (1) also above a door lintel (6), for tall users 2) to place the bar that can be easily removed (1) internally to door (16) passage, for short users, thanks to rotating adjusting junctions (18,18'). Said uprights (2,2') can be placed externally to door jambs (7), opposite to the opening side of the door (16). Therefore this structure does not prevent from using a door, and allows the user to briefly exercise any time he passes through that door.

BRIEF DESCRIPTION OF DRAWINGS

FIG. 1 shows the hanging exerciser (3) having the bar for hanging (1) positioned above door lintel (6), to be used by a tall person.

FIG. 2 shows the adjustable rotating junction (18) mounted on an upright (2).

FIG. 3 shows a detail of adjustable rotating junction (18).

BEST MODE FOR CARRYING OUT THE INVENTION

Figure 4:
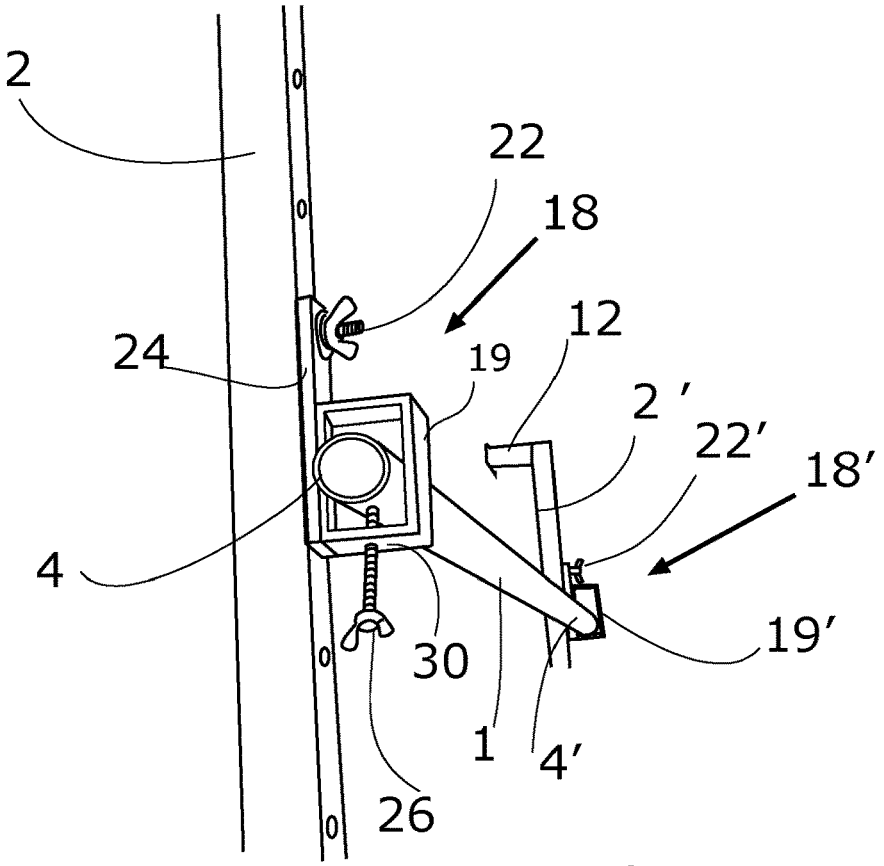
FIG. 4 shows how the bar (1) can be positioned horizontal by maneuvering adjusting screw (26).
Figure 5:
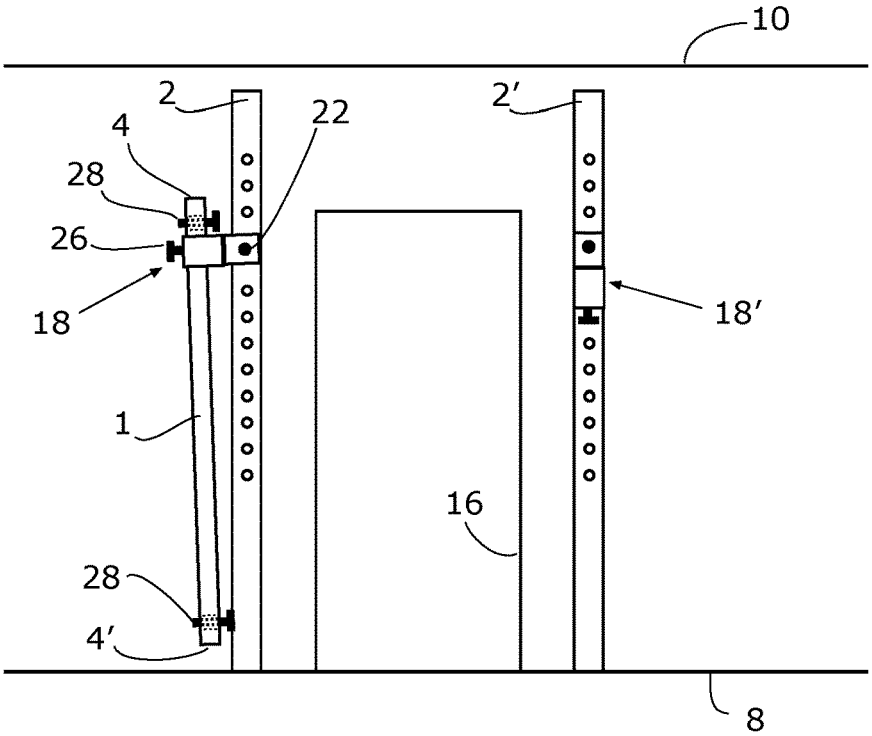
FIG. 5 shows how it is possible to free the passage through a door (16) when bar for hanging (1) is positioned to be used by a short person [bar (1) lays vertical thanks to rotating junction (18)].

Two uprights (2,2') have short mounting brackets (12) for connection to a wall (14) such as spacers for keeping a comfortable space for the user's hands when holding the hanging bar. (1). The base (5,5') of each upright unloads the weight to the floor (8). Each upright (2,2') has a plurality of through-holes (20) for removable connection to an adjustable rotating junction (18,18'). With reference to FIG. 3, said junction (18) comprises a plate (24) downwards connected to a tubular element (19). Plate (24) has a hole for rotating and removable connection to a screw (22) passing through a hole (20) located in upright (2). Tubular element (19) has an adjusting vine (26) screwed through its bottom that moves upwards or downwards the end (4) of the bar (1) when said end (4) is inserted in tubular element (19). Therefore tubular element (19) is of such dimension as to permit end (4) to move up and down. By maneuvering adjusting screw (26) it is possible to place bar (1) perfectly horizontal. If the user is short, bar (1) is to be positioned in the door passage space (16) when used, and must be easily removed when the passage (16) is not used. It is therefore possible to extract second end (4') from junction (18') and to rotate junction (18) to put bar (1) in vertical position, out of the passage space (16). This is made possible by means of top screw (22), which permits such a rotation between bar (1) and upright (2).

So a bar can be placed perfectly horizontal (1) by two operations: 1) connection of junctions (18,18') to a hole (20, 20') positioned at the same level; 2) precise adjusting by maneuvering adjusting screw (26). Bar (1) must be placed in a way that prevents it from coming out from tubular element (19) when not desired. Therefore ends (4,4') of bar (1) are provided with removable blocking elements (28,28').

INDUSTRIAL APPLICABILITY: The present invention can be produced by blacksmith manufactures or by furniture industry or sport equipment or similar. Present description discloses only one way to realize the present invention, which is better defined by the following claims.

The invention claimed is:

1. An exerciser comprising: a bar for hanging one's own body supported by a first upright and a second upright resting on a floor and fixed to a wall, each ending portion of said bar connected in a detachable way to one of the first upright or the second upright by means of a first junction that can rotate in a vertical plane, said first junction comprising at least one elongated plate having an upper hole in an upper part and having a lower tubular body in a lower part, said upper hole for a housing of an upper screw for connection with a corresponding hole existing in the first upright said lower tubular body housing a first end of said bar, a second end of said bar being housed in a tubular body of a second junction connected to the second upright.

2. The exerciser according to claim 1, wherein each of the first upright and the second upright is provided with a device for adjusting a position of said junctions on each of the first upright and the second upright.

3. The exerciser according to claim 2, wherein said device for adjusting the position of said junctions on each of said uprights comprises a series of holes in which to set fastener.

4. The exerciser according to claim 2, wherein the bar has at each end at least one retainer.

5. The exerciser according to claim 2, in which said uprights are connected to said wall by means of spacers.

6. The exerciser according to claim 1, wherein each of said junctions is provided with a system for adjusting its position on each of said uprights.

7. The exerciser according to claim 1, wherein at least one of said tubular bodies comprises at least one adjusting screw passing through a lower part of said respective tubular body and screwable upwards to vary a height of said respective end of said bar housed therein.

8. The exerciser according to claim 1, in which said uprights are connected to said wall by means of spacers.

* * * * *